US006475296B1

(12) United States Patent
Gauchon et al.

(10) Patent No.: US 6,475,296 B1
(45) Date of Patent: Nov. 5, 2002

(54) DEGREASING COMPOSITION AND METHODS USING SAME

(75) Inventors: Jean-Paul Gauchon, Pertuis (FR); Jacques Delagrange, St Pamlet de cuisson (FR); Maria Faury, Aix en Pie (FR); Bruno Fournel, Veroon (FR)

(73) Assignees: Electricite de France, Paris (FR); Commissariat A l'Energie Atomique, Paris (FR); Compagnie Generale des Matieres Nucleaires, Velizy Villacoublay (FR)

( * ) Notice: Subject to any disclaimer, the term of this patent is extended or adjusted under 35 U.S.C. 154(b) by 0 days.

(21) Appl. No.: 09/744,568

(22) PCT Filed: Jul. 30, 1999

(86) PCT No.: PCT/FR99/01899

§ 371 (c)(1),
(2), (4) Date: Jan. 25, 2001

(87) PCT Pub. No.: WO00/08652

PCT Pub. Date: Feb. 17, 2000

(30) Foreign Application Priority Data

Jul. 31, 1998 (FR) ..... 98 09871

(51) Int. Cl.[7] ..... G21F 9/00; C23G 1/14; C11D 1/72

(52) U.S. Cl. ..... 134/40; 134/2; 134/39; 134/41; 134/42; 510/110; 510/245; 510/252; 510/267; 510/271; 510/272; 510/421; 510/435; 510/436; 510/475

(58) Field of Search ..... 510/110, 245, 510/252, 267, 271, 272, 421, 435, 436, 475; 134/2, 39, 40, 41, 42

(56) References Cited

U.S. PATENT DOCUMENTS 5,393,454 A 2/1995 Mondin et al. ..... 252/174.23

FOREIGN PATENT DOCUMENTS

| | | | | |
|---|---|---|---|---|
| DE | 25 39 343 | | 3/1976 | |
| EP | 0 674 323 A1 | | 9/1995 | |
| FR | 2 679 458 | | 1/1993 | |
| FR | 2 723 465 | | 2/1996 | |
| JP | 4258697 | * | 9/1992 | ..... C11D/10/02 |

OTHER PUBLICATIONS

Derwent Publications Ltd., London, GP; Class A97, AN 85–157703, XP002099495 & SU 1 127 918 A (Volkova OB), Dec. 7, 1984, agrege; EP 0 674 323 A (Commissariat Energie Atomique) Sep. 27, 1995, revendication 1; FR 2 679 458 A (Commissariat Energie Atomique), Sep. 27, 1995, revendication 1.

* cited by examiner

*Primary Examiner*—Mark Kopec
*Assistant Examiner*—Brian P. Mruk
(74) *Attorney, Agent, or Firm*—Anderson Kill & Olick; Eugene Lieberstein; Michael N. Meller

(57) ABSTRACT

The present invention relates to a degreasing composition, to a liquid, to a gel and to a degreasing foam which comprise said composition.

The composition according to the invention comprises a base, a polyethoxylated fatty alcohol, saturated or unsaturated, a copolymer of ethylene oxide and propylene oxide, and water. The invention also relates to a degreasing and/or decontamination process of a surface using said composition, said liquid, said gel, and/or said degreasing foam.

24 Claims, No Drawings

DEGREASING COMPOSITION AND METHODS USING SAME

TECHNICAL FIELD OF THE INVENTION

The present invention relates to a degreasing composition, as well as to a gel and a degreasing foam which comprise said composition.

The present invention also relates to a process for degreasing and/or decontamination of a surface using said composition, said gel and/or said degreasing foam.

The present invention finds for example, but without being limited to, an application for degreasing surfaces, in particular metallic surfaces such as equipment, components, floors, etc. of a reprocessing plant for irradiated nuclear fuels. These surfaces are, or can be, in contact with one or several greasy substances, which can be contaminated. It is therefore necessary to clean these surfaces regularly with the aim of purification and/or radioactive decontamination.

For example, one of these substances is a solvent called tributyl phosphate (TBP) which is used in extraction cycles of radioactive metals such as, for example, uranium or plutonium. During these extraction cycles this solvent acquires a particularly high radiochemical activity, since it can contain up to several tens of grams of uranium and/or plutonium per litre. This solvent can thus become a high activity solvent (HA solvent) or a very high activity solvent (THA solvent). The presence of these HA and THA solvents on certain components of reprocessing plants for irradiated fuels, such as mixer-settlers, extraction columns etc. often leads to the formation of particularly organophilic metallic surfaces which encourage ulterior greasy deposits. These greasy deposits are almost insensible to rinsing by the classic aqueous solutions used in reprocessing and thus require a specific treatment.

On the other hand, the degradation products of TBP obtained by radiolysis of the solvent, for example hydrogenodibutyl phosphate (HDBP) form precipitates with most metallic cations such is iron III, thorium IV, uranium IV, plutonium IV, europium III, neodymium III, zirconium IV etc. which can be present during reprocessing of nuclear wastes, in particular irradiated fuels. These metals often deposit on the surfaces of the components of the reprocessing plants in contact with them, in the form of colloids. Decontamination of these surfaces requires erosion of a depth of 2 to 10 $\mu$m to be able to eliminate all traces of radiochemical activity. This erosion can only be efficient after elimination of the greasy solvent covering these surfaces. It is therefore necessary, in order to decontaminate these surfaces, to use products and processes appropriate for degreasing, first of all.

The composition, the gel and the foam as well as the degreasing and/or decontamination process of objects according to the present invention constitute efficient means for degreasing and/or decontamination of these surfaces.

In general, the invention is evidently not limited to the applications cited above, and can find an application in all the fields where rapid and efficient degreasing of an installation is necessary. Examples of such applications will be given below in the explanation of the invention.

STATE OF THE ART

In the case of degreasing a metallic surface which has been in contact with a solvent such as TBP and/or its derivatives such as HDBP, dihydrogenomonobutyl phosphate ($H_2MBP$), and tetrapropylenehydrogen (TPH), the technique usually used consists of a succession of rinsing sequences of the surface to be degreased using rinsing solutions which are concentrated solutions of caustic soda and nitric acid. These sequences have to be repeated 5 or 10 times and the concentrations of the solutions used are of the order of 3 to 10 mol.l$^{-1}$, for example 5.5 mol.l$^{-1}$.

However, this technique is not very efficient and brings about numerous inconveniences. In fact, the nitric acid is not able to solubilize completely the precipitates formed on the surfaces which are still greasy, in particular precipitates composed of metal dibutyl phosphate.

In addition, results of radioactivity analyses of rinsing solutions, after rinsing, show that there is no important radioactivity peak showing efficient and rapid rinsing, but a slightly higher radioactivity after two or three rinsing sequences tending after that towards a limit, with greater activity when the rinsing solutions are renewed.

Moreover, in this technique, the rinsing solutions are used in large quantities, up to five or ten times the volume of the equipment to be degreased, and at a very high concentration, of the order of 3 to 10 mol. l$^{-1}$. This technique, even though it is widely used, thus leads to a significant rise in wastes from reprocessing of spent nuclear fuels.

Finally, it can be difficult to separate the greases from the rinsing solutions of prior art efficiently, for example during reprocessing procedures of these effluents.

By reading the following description, it will be easily understood that the present invention not only makes it possible to solve the inconveniences cited above in the domain of reprocessing nuclear waste, but also in the different industrial and domestic domains in which degreasing of surfaces is necessary.

DESCRIPTION OF THE INVENTION

The present invention has precisely the aim of providing a composition, a liquid, a gel and a degreasing foam which allow efficient and rapid degreasing of a surface, and a reduction of the volume of effluents formed in comparison with prior art techniques.

The surfaces concerned can be any type of surface resistant to the degreasing composition according to the invention, for example a metallic surface, a glass surface, a plastic surface, a concrete surface etc. The metallic surface can, for example, be a steel surface, an austenitic steel surface, a uranus, aluminium zirconium surface etc.

These surfaces can be degreased with a greasy substance which can be a greasy solvent such as TBP, HDBP, $H_2MBP$, TPH, or a mixture of these solvents, diverse oils such as alimentary oils, lubrication oils etc.

The degreasing composition according to the invention is characterised in that it comprises a base, a polyethoxylated fatty alcohol, saturated or unsaturated, a copolymer of ethylene oxide and propylene oxide, and water.

According to the invention, the base can, for example, be caustic soda or an equivalent base such as alcoholic potash, sodium or potassium carbonate, etc.

According to the invention, the base can have, for example, a concentration in $OH^-$ ions chosen from among a range from 0.1 to 1.5 mol.l$^{-1}$ in said composition.

According to the invention, the polyethoxylated fatty alcohol can be a compound of the general formula:

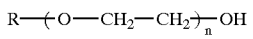

(I)

in which R is an alkyl with a long carbonaceous chain, saturated or unsaturated, comprising between 10 to 24 carbon atoms, and in which n represents the number of monomeric units of ethylene oxide, n being able to vary between 10 and 30.

The fatty alcohol can for example be lauryl alcohol, myristyl alcohol, cetyl alcohol, stearyl alcohol, arachidyl alcohol, palmitic alcohol, oleic alcohol, linoleic alcohol, or a mixture of these.

According to the invention, n can be, for example, equal to 10 or 20.

According to the invention, the polyethoxylated fatty alcohol can for example be an ether of oleic alcohol and an ethylene polyoxide at 20 monomeric units of ethylene oxide.

In the composition according to the invention, the polyethoxylated fatty alcohol, saturated or unsaturated, can be at a concentration within a range from about 0.01 to 1.5% by weight, or at a concentration chosen in a range from about 0.05 to 0.8% by weight in said composition or yet again at a concentration chosen in a range from about 0.05 to 0.4% by weight in the composition following the utilisation of the composition according to the invention for making a degreasing liquid, foam or gel.

According to the invention, the copolymer of ethylene oxide and propylene oxide can for example be a block copolymer. It can comprise monomeric units of the ethylene oxide type and monomeric units of the propylene oxide type, respectively referred to hereinafter as OE and OP. This copolymer will then have the following formula (I):

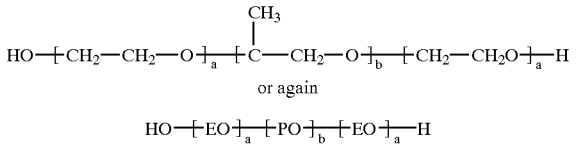

(I)

or again with a, for example, equal to 22 and b, for example, equal to 9.

Those skilled in the art will understand easily that the copolymer of ethylene oxide and propylene oxide can be replaced by another copolymer presenting the same or almost the same properties.

According to the invention, the copolymer of ethylene oxide and propylene oxide can be at a concentration chosen within a range from about 0.025 to about 1.5% by weight, or yet again at a concentration chosen within a range from about 0.025 to about 0.6% by weight, or yet again at a concentration chosen within a range from about 0.025 to about 0.4% by weight, or yet again at a concentration chosen within a range from about 0.4 to about 1.5% by weight, depending on the utilisation of the composition according to the invention to make a degreasing liquid, foam or gel.

For example, the base can be caustic soda, polyethoxylated fatty alcohol, saturated or unsaturated, can be a polyethoxylated oleic alcohol comprising 10 or 20 units of ethylene oxide, for example 20 units, and the copolymer of ethylene oxide and propylene oxide can be a block copolymer with 45 monomeric units of ethylene oxide and 9 monomeric units of propylene oxide.

The composition according to the invention can also comprise a foam inhibitor agent when it is used in liquid form, hereafter called a degreasing liquid, or under the form of a gel. This inhibitor agent has the role of preventing the formation of foam when the composition according to the invention is used in liquid form or in gel form. This inhibitor agent can for example be an alkyl phosphate, branched or not. The alkyl phosphate in the degreasing liquid or gel according to the invention also makes it possible to raise the micellisation capacity, for example TBP, by the two other surfactants. According to the invention, the alkyl phosphate can be branched, it can comprise from 4 to 12 carbon atoms, for example 6 to 10 carbon atoms, and can be mono- or poly-dispersed. According to the invention, when the foam inhibitor agent chosen is an alkyl phosphate comprising from 6 to 10 carbon atoms, it can for example be at a concentration chosen within a range from about 0.1 to about 0.4% by weight in the composition. This concentration is, for example, favourable for a concentration in $OH^-$ ions ranging from, for example, about 0.5 to about 1 mol. $l^{-1}$.

According to the invention, the composition described above can be under concentrated form, for example for stocking. Thus, when this concentrated composition needs to be used, it can be used as such or diluted with water to form a composition with concentrations of each of the constituents of this composition as required for efficient degreasing of a surface.

Thus, the present invention relates in particular to a degreasing liquid comprising a composition according to the invention, able to comprise between 0.05 to about 0.4% by weight of polyethoxylated fatty alcohol, about 0.025 to about 0.6% by weight of copolymer of ethylene oxide and propylene oxide, and also able to comprise a foam inhibitor agent such as that described above.

This foam inhibitor agent, for example when it consists of a branched alkyl phosphate comprising 6 to 12 carbon atoms, can be at a concentration of about 0.1 to about 0.4% by weight in the degreasing liquid according to the invention.

The present invention also relates to a degreasing foam comprising a gaseous phase and a degreasing composition according to the invention, and also being able to comprise a foam destabilising agent.

The gaseous phase can be, for example air, for example an inert gas such as argon, or any other gas able to form foam with the composition according to the invention. The foam can be formed by different means such as mechanical agitation, generation through a porous packing etc.

According to the invention, a degreasing composition encouraging formation of a foam can comprise a polyethoxylated fatty alcohol, saturated or unsaturated, which can be of a concentration chosen in a range from about 0.4 to about 1.5% by weight, a copolymer of ethylene oxide and propylene oxide which can be of a concentration chosen in a range from about 0.4 to about 1.5% by weight and can also comprise a foam destabilising agent.

According to the invention, the agent for destabilising foam can be any one of the foam destabilising agents known to the professional, for example a compound chosen amongst those described above as foam inhibitors. For example, the foam destabilising agent can be an alkyl phosphate, branched or not, comprising from 4 to 12 carbon atoms, or yet again from 6 to 10 carbon atoms and able to be mono- or poly-dispersed.

According to the invention when the foam destabilising agent chosen is a branched alkyl phosphate comprising from 6 to 10 carbon atoms, it can be at a concentration of 0.2 to 1.1% by weight in the composition according to the invention, for a weight ratio, in the composition, of the concentration of polyethoxylated fatty alcohol, saturated or unsaturated, on the concentration of the copolymer of ethylene oxide and propylene oxide equal to about 1.5.

The invention also relates to a degreasing gel comprising a degreasing composition according to the invention, and also comprising a viscosity agent.

According to the invention, the degreasing gel can comprise the degreasing composition according to the invention in which the polyethoxylated fatty alcohol, saturated or unsaturated, can be at a concentration chosen from a range from about 0.05 to about 1% by weight or yet again from a range from about 0.05 to about 0.4% by weight, and in which the ethylene oxide copolymer can be at a concentration chosen from within a range from about 0.025 to about 0.4% by weight, and also comprising a viscosity agent.

This viscosity agent can be, for example, a compound chosen from a group comprising xanthan gum, an alumina oxide or a silica gel.

According to the invention, when the viscosity agent is xanthan gum, it can be at a concentration chosen in a range from 0.5 to about 5% by weight of said composition, for example at a concentration of about 1.2% by weight.

The invention thus relates in particular to a composition, a liquid, a foam, and a gel comprising said composition. These different formulations, that is to say liquid, foam and gel, allow rapid and efficient degreasing of a surface such as those mentioned above. It has been noted that the present invention allows, in particular, a reduction of the quantity of effluents resulting from degreasing and a lowering of the concentration in $Na^+$ of these effluents compared to prior art, and consequently a reduction in wastes from degreasing, for higher degreasing efficiency.

The degreasing efficiency of the present invention is due in particular to the nature of the different constituents of this composition and their concentration.

The composition according to the invention comprises a base. This base makes it possible to form a basic aqueous solution which facilitates degreasing of a surface as well as a transfer of the greasy substance from these surfaces into the aqueous solution in the form of an emulsion. The degreasing efficiency of the composition is in particular a function of the alkalinity of this aqueous solution. According to the invention, the base used can be of a concentration in $OH^-$ ions chosen from within a range from 0.1 to 1.5 $mol.l^{-1}$. In the example of caustic soda, compared to solutions used in prior art mentioned above, the composition according to the invention thus makes it possible to economise $Na^+$ ions by up to a factor of 10 for a same number of rinsing sequences applied to a surface to be degreased and for better efficiency. The base can also be a base equivalent to caustic soda, for example sodium bicarbonate.

The composition according to the invention also comprises a polyethoxylated fatty alcohol, saturated or not. This polyethoxylated fatty alcohol is a non-ionic surfactant comprising a lipophilic chain formed by the fatty alcohol and a polar head formed by the polyethoxyl. The lipophilic chain makes it possible for the composition according to the invention to ensure optimum detergency and dispersion of greasy substances, or lipophilic organic constituents, in the basic aqueous solution. The polar head makes it possible to ensure solubility in the alkaline aqueous phase. For example, the polyethoxylated fatty alcohol of the composition according to the invention can be constituted of an oleic alcohol and an ethylene polyoxide composed of a chain of twenty monomeric units of ethylene oxide such as represented by the following formula (II):

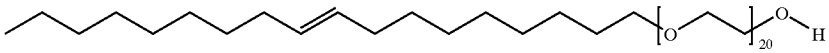

This polyethoxylated fatty alcohol can, for example, be SIMULSOL 98 or SIMULSOL 96 (Trademarks) manufactured by the SEPPIC company.

This polyethoxylated fatty alcohol, with greasy substances, forms micelles which are spherical particles of a diameter between 50 and 150 nm comprising a polar external face in contact with the greasy substances. The greasy substances are retained within these micelles and dispersed with them in the basic aqueous solution. The result of this retention and this dispersion is that the greases dissolve in the basic aqueous solution.

The composition according to the invention also comprises a polymer of alkilene oxide. This polymer is a non-ionic surfactant. In particular it makes it possible to give the alkaline aqueous solution of the invention good wettability of the surface to be degreased, and inhibits possible foaming of the aqueous solution resulting from degreasing when the latter is submitted to treatment such as concentration by evaporation, for example in the example of TBP and its derivatives, before calcination with a view to incorporation in a vitreous matrix. An example of a polymer of alkilene oxide suitable for the composition according to the invention can be a block copolymer with 45 ethylene oxides and 9 propylene oxides as represented by formula (III) below:

(III)

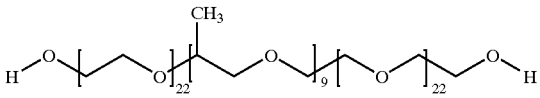

This copolymer has a molar mass of 2500 $g.mol^{-1}$ and a hydrophilic lipophilic balance (HLB) of the order of 15.

The polymer of alkilene oxide can, for example, be SYNTHIONIC P8020 (Trademark) manufactured by the WITCO company, or PLURONIC PE (Trademark) particularly of type 6400, 6800, 9400 and 10500, manufactured by the BASF company.

When the chosen formulation is a liquid or a gel, the composition according to the invention can also comprise a foam inhibitor agent. In fact, the composition according to the invention comprises a surfactant agent, which in certain conditions can bring about the formation of a foam. This foam may be in the way, for example in a degreasing process using an airlift. This foam inhibitor agent can, for example, be an alkyl phosphate comprising from 4 to 12 carbon atoms such as represented by the following formula (III):

(III)

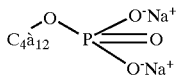

This inhibitor agent makes it possible to raise the drainage speed of the interstitial liquid contained in a forming foam, and thus to limit or prevent this formation. It also makes it possible to improve the wetting power of the composition and can play an important role in the retention of the greasy substance(s) in the micelles. It thus also makes it possible, as emphasised above, to raise the micellisation capacity, for example the TBP, through the two surfactants of the composition according to the invention. Examples of alkyl phosphate are MONTALINE ANP and SEPPIC 619NP (Trademarks) manufactured by the company SEPPIC. They act as a dispersing agent and, for example, make it possible to keep in suspension precipitates of dibutyl phosphates of Pu, Am, U and Zr, produced by the extraction of the solvent in an alkaline medium.

When the formulation chosen is a foam, the composition according to the invention can also comprise a destabilising foam agent. This destabilising agent can be the same as the foam inhibitor agent mentioned above, but in this case it makes it possible to control the stability of the foam formed, that is to say the time necessary for total transformation of a given volume of this foam into liquid or gas. This time, or lifetime, can be modified by changing the concentration of this destabilising agent in the composition according to the invention. This destabilising agent facilitates draining of the interstitial liquid in the foam.

In general, the concentration of the destabilising agent is chosen to obtain a foam lifetime of 10 to 30 minutes. Such a lifetime can be adapted for example to fill a container of a given volume in a reasonable time and to have a foam with a drainage level sufficient for the composition according to the invention to be able to degrease the surface of this container. In fact, when the foam has filled the container, it produces, if its lifetime is correctly chosen, a drainage liquid which by flowing around the walls of the container dissolves the greasy substance, for example TBP and its derivatives, and carries it away in the form of micelles. The drainage liquid, filled with these micelles, can then be recuperated in a lower part of the container, and can be recycled.

When the formulation chosen is a gel, the composition according to the invention can also comprise a viscosity agent. This viscosity agent makes possible, for example, a controlled local application of the gel formed comprising the composition according to the invention for degreasing a surface accessible to an operator. An example of viscosity agent which can be added to the composition according to the invention is xanthan gum. It is a polysaccharide comprising a chaining of 16 molecules, of which 13 are linear and three branched, and its molecular weight is of several millions. It permits the formation of non-Newtonian gels which are resistant to heat and pH variations.

As described above, the degreasing of a surface consists in particular of solubilizing in an aqueous solution the substance or substances present on the surface to be degreased in the form of micelles. These micelles are formed in particular with polyethoxylated fatty alcohol, saturated or unsaturated, and containing the solubilized greasy substance or substances.

The micelles are dynamic particles which form and then break down ceaselessly in the solution. When the concentration of one of the constituents of the composition according to the invention is too low, especially in comparison to the quantity of greasy substance(s) to be dissolved, the micelles can dissociate and liberate the greasy substances or substance which then resettle(s) on the degreased surfaces. The dissociation of micelles is visible and causes clouding in the solution. This dissociation can occur when the composition according to the invention is saturated in greasy substance(s), and/or from a certain temperature.

The saturation of the composition according to the invention by a greasy substance can be measured by measurement of the "cloud point" of this composition. The cloud point is expressed in degrees Celsius (° C.). The polyoxyethylene non-ionic surfactant cloud point corresponds to partial dehydration of the hydrophilic chain which is translated, if the cloud point temperature is reached, by phase separation, that is to say the un-mixing of the surfactant.

If the cloud point occurs at ambient temperature, this can cause a resettling of the greasy substance on the degreased surfaces, at ambient temperature. It is therefore preferable for the cloud point of the composition to be higher than ambient temperature, that is by about 20° C., when the degreasing is carried out at ambient temperature or at a temperature higher than this. Moreover, a high cloud point brings about a higher extraction capacity of a greasy substance. The measurement of the cloud point thus makes it possible in particular to measure the degreasing efficiency of the composition according to the invention. This degreasing efficiency can also be estimated by a measurement of the wettability of this surface.

The degreasing efficiency of a surface by the composition according to the invention is thus due in particular to the nature of the constituents of this composition. This efficiency is also due to the concentrations of its different constituents.

The concentration of each of the constituents of the composition according to the invention can be adjusted, using ranges of concentrations described above, particularly in function of the nature and the quantity of the greasy substance(s) present on the surface to be degreased, the surface to be degreased, the formulation of liquid, foam or gel used, and the temperature at which degreasing is carried out.

In an embodiment of the present invention, the composition according to the invention comprises caustic soda or an equivalent base, an ether of oleic alcohol and a polyoxide of ethylene comprising 20 units of ethylene oxide, and a block copolymer with 45 units of ethylene oxides and 9 units of propylene oxides called block copolymer hereinafter.

In a first variant of this embodiment, the composition described above is used to form a degreasing liquid. It may be preferable to adjust the concentration of each of the constituents mentioned above so that this liquid is only slightly foaming. Thus, for example, a degreasing liquid comprising about 0.5 to about 1 $mol.l^{-1}$ of NaOH, about 0.05 to about 0.4% by weight of polyethoxylated oleic alcohol, preferably between about 0.05 and about 0.2% of this alcohol, and about 0.025 to about 0.4% by weight of the block copolymer, or again about 0.1 to about 0.4% by weight, or again about 0.2 to about 0.4% by weight of this copolymer is a composition which is only slightly foaming. The liquid can also comprise a foam inhibitor agent. According to this first variant, the composition according to the invention has a cloud point higher than ambient temperature, equal to about 38° C., and even higher than 40° C.

A reduction in the concentration of polyethoxylated fatty alcohol or in block copolymer can raise this cloud point.

Such a composition makes it possible, for example, to carry out efficient degreasing of a metallic blade covered with about 1 mg/cm$^2$ of a mixture comprising TBP and its derivatives HDBP and $H_2$MBP, or a mixture comprising TPH, TBP and its derivatives HDBP and $H_2$MBP in a length of time ranging from about 15 minutes to about 200 minutes, without agitating, and at a temperature of 20° C. The degreased blade can in fact have a surface tension cos θ tending towards 0, which means quasi-total or total degreasing of the surface.

Nonetheless, in certain cases, in particular for a concentration of polyethoxylated oleic alcohol, that is to say in oleic alcohol ether and polyoxyethylene glycol, about equal to or higher than 0.2%, this formulation can become foamy when the concentration in NaOH is less than or equal to about 0.5 mol.l$^{-1}$. The composition can then be adjusted and can also comprise a foam inhibitor agent. This is the case, for example, for utilisation in a degreasing process using agitation or transport of this liquid composition by means of an airlift. In fact, the pressure and agitation undergone by the liquid in such a process requires a composition with low foaming properties. The foam inhibitor agent can, for example, be an alkyl phosphate such as that mentioned above, at a concentration ranging from about 0.1 to about 0.4% by weight, or again from about 0.3 to about 0.4% by weight in the composition. When this inhibitor agent is added to the composition, in order to preserve and possibly improve the degreasing power of the composition, it may be necessary to raise the concentration in ether of oleic alcohol and of polyoxyethylene glycol to about 0.3% by weight. Too great a quantity of the latter, and of the alkyl phosphate in the composition, may however reduce the quantity of greasy substance(s) able to be retained in the micelles. The block polymer concentration can then be adjusted to a concentration of about 0.15 to about 0.45% by weight to obtain a cloud point lower than 80° C. For example, a composition comprising about 0.2% by weight of ether of oleic alcohol and polyoxyethylene glycol, about 0.35% of block copolymer, about 0.5 to 1 mol.l$^{-1}$ of NaOH, preferably about 0.5 mol.l$^{-1}$ of NaOH, and about 0.4% by weight of alkyl phosphate possesses a cloud point of 68° C. This composition is a slightly foaming composition which permits, for example, extraction of about 3 g/l of TBP and its derivatives, and a degreasing of a surface comprising 1 mg/cm$^2$ of TBP and its derivatives in about 20 min.

This slightly foaming composition is compatible for transport by airlift.

In this first variant, the inventors noted that the cloud point of the composition varies in a linear manner from about 71 to about 20° C. with the caustic soda concentration in an interval ranging respectively from about 0.1 to about 1.45 mol.l$^{-1}$ of NaOH particularly in a natural convecting environment, that is to say without agitation of the solution of the composition during degreasing.

In a second variant, the composition of this embodiment is used in foam form.

The production of a foaming solution from the composition according to the invention can be carried out, for example, with a concentration in ether of oleic alcohol and of polyoxyethylene glycol ranging from about 0.4% to about 1.5% by weight, for example from about 0.4 to about 1% by weight, for example with a caustic soda concentration ranging from 0.5 to 1.5 mol.l$^{-1}$. For example, when the weight ratio between the concentration in ether of oleic alcohol and polyoxyethylene glycol to the block copolymer concentration is about 1.5 to about 2.5, the concentration in ether of oleic alcohol and polyoxyethylene glycol can be from about 0.35 to about 0.60% by weight. These concentrations can be adapted to the quantity of the greasy substance(s) to be dissolved.

This composition is appropriate, for example, for generating foam from a foam generator comprising a porous packing. This foam generator can, for example, be composed of a cylinder 120 mm long and 8 mm in diameter filled with 3.24 g of a packing of the FORAFLON (Trademark) type. The foam can be generated for example with a flow rate of a solution of this composition ranging from about 23 to about 28 l/hr, and a gas flow rate, for example air, of about 88 l/hr in normal conditions of temperature and pressure. The foam can be generated easily in this example with a flow rate ranging from about 120 to about 130 l/hr. This foam can have an expansion, that is a ratio between the volume of foam generated and the volume of interstitial liquid, ranging from about 6 to about 7. This foam is suitable, for example, for dissolving easily 1.2 g/l of TBP and its derivatives.

According to the invention, the ratio of gas flow and liquid flow can be about 6 to 7 to generate a foam from a composition according to the invention and a gas.

As described above, it can be interesting to control the lifetime of the foam generated by adding, for example, a foam destabilizer. This foam destabilizer can, for example, be an alkyl phosphate such as that described above, at a concentration ranging from about 0.2 to about 1.1% by weight in the composition, for example, when the composition comprises a weight ratio of polyethoxylated fatty alcohol, saturated or unsaturated, to the concentration of the copolymer of ethylene and propylene oxides equal to about 1.5 (that is to say a molar ratio about equal to 3.3). For example, the alkyl phosphate can be about equal to 0.3% by weight.

For example, when the caustic soda has a concentration greater than or equal to 0.5 mol.l$^{-1}$, the alkyl phosphate can be at a concentration of about 0.3 to about 0.5% by weight, and when the caustic soda has a concentration of less than 0.5 mol.l$^{-1}$, the alkyl phosphate can be at a concentration of about 1% by weight.

This composition is especially efficient for degreasing, for example, a metallic surface on which there is TBP and its derivatives.

This latter composition makes it possible, for example, to form a foam at a flow rate of about 1.6 m$^3$/hr for a flow rate of an aqueous solution of this composition of about 200 l/hr and a gas flow rate, for example air, of about 1200 l/hr in a foam generator of a volume of 77 cm$^3$ and with a diameter of 2.4 cm comprising 29 g of porous packing of the FLORAFLON (Trademark) type. The foam formed can have a lifetime, with the concentrations given above, ranging from about 10 to about 30 minutes. According to these concentrations, the composition according to the invention can make it possible to dissolve up to 4 g/l of TBP and its derivatives. The flow rate of foam and its expansion can be raised when the concentration in alkyl phosphate passes from 0.3 to 0.4% by weight in this composition.

In a third variant of this embodiment, the composition is used in the form of a gel. According to this third variant, the composition according to the invention can comprise for example about 0.05 to about 1% by weight or again about 0.05 to about 0.4% by weight of ether of oleic alcohol and ethylene polyoxide, from about 0.025 to about 0.4% by weight of block copolymer, a foam inhibitor and a viscosity agent. The viscosity agent can be xanthan gum. This viscosity agent can be added in a quantity making it possible to obtain a gel with a viscosity, for example, of about 0.8 Pa.s (800 cps). When the viscosity agent is xanthan gum, it can be added, for example, at a concentration of about 1.2% by weight. According to this third variant, it can be advantageous to use a little foaming or low foaming composition such as those described in the first variant of this embodiment of the present invention, that is to say comprising a foam inhibitor.

When the greasy substance to be solubilized is in too great a quantity compared with the concentrations of constituents of this gel, the degreasing of a surface comprising TBP and its derivatives is not affected, but it can produce a triphase solution which can cause resettling of the TBP. A rise in the concentration of ether of oleic alcohol and polyoxyethylene glycol and of block copolymer, for example by 5 to 10 times the concentrations given above, can make it possible to obtain a monophase system under these conditions, that is to say presenting optimum degreasing efficiency.

According to the invention, it appears evident that the concentrations of each of the constituents in each of the embodiment variants mentioned above can be modified depending on the nature and the quantity of the greasy substance or substances to be dissolved to degrease a surface, and in such a way as to reduce as far as possible the volume of degreasing effluents. The concentrations given above are suitable, for example, for decreasing surfaces comprising TBP, TPH, HDBP and $H_2MBP$.

The composition, gel and foam which are the subjects of the present invention make it possible to degrease a surface covered with a greasy substance with which they are put into contact. This contact can come about through any means making it possible to apply a liquid, a foam or a gel on a surface to be degreased or cleaned. According to the invention, the means of contact is chosen preferably as a function of the surface to be degreased, and in such a way as to reduce the effluents from the degreasing as far as possible.

For example, when the composition according to the invention is used in liquid form, the contact between the liquid and the surface to be degreased can be brought about, for example, by soaking with or without agitation, spraying with or without pressure, or by circulation. Soaking can be used, for example, to degrease objects with small sized surfaces or for sealed containers, spraying can be used for example for degreasing larger surfaces, and circulation for example for piping. The liquid form of the composition according to the invention can make it possible, for example, to use transport by airlift for degreasing piping by circulating this formulation through these pipe connections.

When the composition according to the invention is used in the form of a foam, the contact can take place, for example, by soaking or by circulation. Soaking can be used, for example, for degreasing containers and in a more general manner voluminous structures, and circulation can be used, for example, for networks of pipes of large volume in an installation with for example complex internal geometry. The foam formulation makes it possible to diminish significantly the volume of effluents formed in a degreasing process.

Finally, when the composition according to the invention is used under gel form, the contact can take place by applying the gel onto the surface to be degreased, for example with a roller, a cloth, a spatula or a sponge. This application can be used, for example, to degrease a surface accessible to an operator, such as an external surface of an installation, a floor, a retention tank or the bottom of a cell in an installation for reprocessing irradiated fuels. The composition used in gel form can allow more localised contact on a surface to be degreased than liquid or foam.

According to the invention, the contact can be made at any temperature suitable for degreasing a surface with the composition according to the invention. This temperature can be chosen depending on the liquid, foam or gel formulation used, and on the surface to be degreased. The choice of this temperature evidently depends on the cloud point of the composition used. In fact, a temperature higher than the cloud point of the composition causes separation of the micelles of the aqueous solution, taking part of the surfactants and TBP associated with them. The solution becomes diphasic. According to the invention, this temperature can for example be ambient temperature, or a temperature higher than ambient temperature and lower than the cloud point of the composition.

According to the invention, the contact between the composition and the surface to be degreased can be maintained over a length of time which depends, in particular, on the nature and quantity of the greasy substance(s) present on the surface to be degreased, the concentration of each of the constituents of the composition according to the invention, the liquid, foam or gel formulation used, the means used for putting them into contact, and the temperature of the contact. This length of time can be very short and reach 15 to 20 minutes for soaking a surface to be degreased, without agitation and at ambient temperature.

The present invention also relates to a process for degreasing a surface, said process comprising contact of the surface to be degreased with a composition, a liquid, a foam or a gel, according to the invention.

This process applies to degreasing surfaces such as those described above, and makes it possible to eliminate a greasy substance or greasy substances such as those described above.

The contact can be carried out in the conditions described above and with the concentrations of each of the constituents of the composition, foam or gel as described above.

This contact can be repeated once or several times, renewing the composition, foam or gel used for each contact procedure, or not.

This contact can be preceded and/or followed by a treatment, for example in a strongly concentrated acid medium, for example $HNO_3$ in the case of a surface with TPH or TBP or its derivatives, particularly in a plant for reprocessing irradiated fuels.

The surface can then be rinsed, for example with water, and then dried.

This process makes it possible, for example, to degrease surfaces in the workshops of plants for reprocessing nuclear fuels using in particular solvents such as TBP and its derivatives as extraction solvent for the fuels. The process of the invention is an efficient means of degreasing these surfaces and has many advantages over prior art.

In fact, because of the radioactive contamination of the solvents mentioned above, the degreasing effluents from these surfaces must be treated and then be stocked by sealing in bitumen drums. The prior art process for degreasing, with its concentration and the volume of solutions used, produced a significant quantity of degreasing effluents, which were difficult to treat and involved a large number of bitumen or vitreous drums.

The composition and process of the invention makes it possible to reduce the volume of degreasing effluents significantly, and in the example of a composition according to the invention comprising caustic soda, their concentration in sodium, thus reducing the number of bitumen barrels compared to prior art.

In addition, for treating these effluents, the composition according to the invention makes it possible to concentrate the TBP and its derivatives dissolved and retained in the micelles, by evaporation of the water in these effluents. In fact, the concentration of the different constituents of the composition according to the invention can be chosen to have a cloud point lower than the boiling point of TBP and its derivatives.

The invention also provides an efficient means for preparing a surface for radioactive decontamination. In fact, in the reprocessing plants for irradiated nuclear fuels, certain derivatives of TBP, such as HDBP, form precipitates with most of the radioactive metal cations present inside these installations. These precipitates settle on the surfaces of these installations in the form of colloids, and radioactive decontamination of these surfaces requires their erosion over a thickness of 2 to 10 $\mu$m. This erosion can only be efficient after elimination of the greasy solvents on these surfaces, in particular the colloids of TBP and derivatives of the latter, that is to say after efficient degreasing of these surfaces.

In addition, the present invention also relates to a process for radiochemical decontamination of a surface comprising, in the following order: a degreasing of said surface by the process according to the invention, and then radioactive decontamination of the degreased surface.

This radiochemical decontamination process makes it possible to treat surfaces contaminated by numerous radionuclides such as actinides and fission products.

The surfaces, greasy substance(s), compositions, liquid, foam and gel can be those described above.

According to the invention, radioactive decontamination can be decontamination by chemical erosion, for example chemical erosion chosen among a cerium erosive treatment, an HF erosion treatment and a specific ruthenium treatment.

The cerium erosive treatment consists of treating a surface through putting this surface into contact with a treatment solution comprising a mixture of concentrated nitric acid and cerium IV, for a length of time and at a temperature such that the erosion of this surface acts on a thickness of 2 to 10 $\mu$m. The concentration of nitric acid can, for example, be 2 mol.l$^{-1}$ and that of cerium of 0.05 mol.l$^{-1}$. The treatment may, for example, last for 2 hours, at a temperature of 50° C. for example, and may comprise agitation of the treatment solution. This treatment is intended to displace the fixed contamination in complement to the metastable contamination linked with the solvent.

The HF erosive treatment consists of treating a surface by putting this surface into contact with a treatment solution comprising a mixture of concentrated nitric acid and HF, for a length of time and at a temperature such that the erosion of this surface acts on a thickness of 2 to 10 $\mu$m. The concentration of nitric acid can, for example, be 2 mol.l$^{-1}$ and that of HF of 0.1 mol.l$^{-1}$. The treatment may, for example, last for 5.5 hours, at a temperature of 50° C. for example, and may comprise agitation of the treatment solution. This treatment is intended to complex certain radionuclides such as Pu, Zr, U, Am and to displace the fixed contamination on the surface.

The specific ruthenium treatment consists of treating a surface by putting this surface into contact with a treatment solution comprising a mixture of $KMnO_4$ and caustic soda. The concentration of $KMnO_4$ can, for example, be 0.05 mol.l$^{-1}$ and the concentration of caustic soda of 0.5 mol.l$^{-1}$. The treatment may, for example, last for 2 hours, at a temperature of 50° C. for example, and may comprise agitation of the treatment solution. This treatment is intended to eliminate contamination due to ruthenium 106 ($^{106}$Ru) . It can be followed by soaking the surface in nitric acid.

This radiochemical decontamination process is more efficient than that of prior art which comprised degreasing by the method of prior art and an oxidation treatment which made it possible to solubilize the ruthenium oxides. In fact, the process of the invention makes it possible to improve the radiochemical decontamination of a surface to a significant extent, since measurements of residual radioactivity of surfaces decontaminated by this process have shown a residual activity up to 20 times lower than that obtained by the prior art process, and measurement of the decontamination factor DF of these surfaces has shown an improvement of the order of 10 compared with prior art.

It is to be noted that this process also makes it possible to reduce the quantities of caustic soda used compared to prior art by up to 11 times, when the composition comprises caustic soda, with better degreasing efficiency.

In addition, tests carried out without agitation of the degreasing solutions have shown a degreasing of surfaces which is just as efficient as with agitation.

A study of the compatibility of the composition according to the invention with the different treatments of degreasing effluents and possibly decontamination of surfaces of a reprocessing plant for irradiated fuels was carried out. This study showed that a concentration by evaporation of the effluent, in a neutral or acid medium, with a view to reducing the volume by about 10 times, resulted in obtaining a biphasic concentrate, which can be emulsified by pumping for transfer for chemical treatment. Chemical precipitation in an effluent which is not concentrated in diverse mineral absorbents of radioelements such as insoluble hydroxides, sulphates and ferrocyanides, and an associated absorption of inactive tracers of Cs, Sr, Ce, Ru, on these compounds are not modified by the presence of a composition according to the invention. A comparison of the decontamination factors in the absence or presence of a composition according to the invention shows that there is no modification of performance of a chemical insolubilization process due to this composition. In addition, the quantity of sludge formed remains identical with or without the composition according to the invention. Sedimentation of the suspensions, used as a means for separating solids/liquids in a second stage of chemical treatment of the effluents is hardly disturbed by the presence of surfactant compounds. In fact, a solid/liquid separation on rotating filter with a diatom pre-coating, carried out under partial vacuum, does not present any problem with a composition according to the invention, for example when it has a concentration of about 1.38 g/l in aqueous solution: no foaming is observed and the presence of the composition according to the invention does not disturb filtration.

Many other advantages of the present invention will become clear by reading the following examples, provided evidently as illustrative but non-limiting.

EXAMPLE 1

Comparative Example of Degreasing

This example is a comparative example of the degreasing efficiency of a composition and a process in conformity with the invention relating to solutions and a process of prior art.

In this example, the surface to be degreased is an austenitic steel blade covered with about 1 g/cm$^2$ of one of the following mixtures A and B which represent the greasy substance to be dissolved.

Mixture A: 0.9% by weight of TBP+0.1% by weight of a mixture comprising 60% of HDBP and 40% of $H_2$MBP.

Mixture B: 0.7% by weight of TPH+0.27% by weight of TBP+0.03% by weight of a mixture comprising 60% by weight of HDBP and 40% by weight of $H_2$MBP.

The process according to prior art comprises the following sequences, in this order, and with agitation of the solutions used, by means of a magnetic stirring bar, at 500 rev/min:

soaking of each blade in a solution of nitric acid at 5 mol.l$^{-1}$ at a temperature of 50° C. for 60 minutes, rinsing of each blade with water at a temperature of 50° C. for 5 minutes, soaking of each blade in a caustic soda solution at 5 mol.l$^{-1}$ at a temperature of 50° C. for 120 minutes, rinsing of each blade with water at a temperature of 50° C. for 5 minutes, soaking of each blade in a solution of nitric acid at 5 mol.l$^{-1}$ at a temperature of 50° C. for 60 minutes, and rinsing of each blade with water at a temperature of 50° C. for 5 minutes.

The process according to the invention comprises soaking each blade in a composition according to the invention, without agitation, at a temperature of 20° C.

In this example, two different compositions according to the invention are used. Each of these two compositions comprises 0.12% by weight of ether of oleic alcohol and polyoxyethylene glycol with 20 units of ethylene oxide, Trademark SIMULSOL 98 manufactured by the company SEPPIC (formula (I) above) and 0.57% by weight of block copolymer with 45 ethylene oxides and 9 propylene oxides Trademark SYNTHIONIC P8020 manufactured by the company WITCO (formula (II) above). The first of these two compositions, hereinafter called composition 1, comprises 0.5 mol.l$^{-1}$ of NaOH, and the second of these compositions, hereinafter called composition 2 comprises 1 mol.l$^{-1}$ of NaOH. The cloud point of these two compositions is 38° C.

The degreasing efficiency of these two processes was compared by measuring the contact angle between an aqueous solution and each degreased metallic blade, using the SCHULTZ method, and by measuring the minimum contact time for total degreasing of these blades. A wetting angle equal to 0 represented total degreasing of the surface, that is to say recuperation of the grease from the metallic surface. In order to displace this grease, the aqueous solution must allow its micellisation.

Table 1 below groups the results of these measurements:

TABLE 1

| | comparative example of degreasing of a metallic blade | | | |
|---|---|---|---|---|
| | MIXTURE ON THE BLADE | | | |
| | MIXTURE A | | MIXTURE B | |
| PROCESS USED | Wetting angle (°) | Minimum contact time (min) | wetting angle (°) | Minimum contact time (min) |
| Prior art | 46.2 | 260 | 62.7 | 260 |
| Composition 1 of the invention | ≅0 | 30 | ≅0 | 30 |

TABLE 1-continued

| | comparative example of degreasing of a metallic blade | | | |
|---|---|---|---|---|
| | MIXTURE ON THE BLADE | | | |
| | MIXTURE A | | MIXTURE B | |
| PROCESS USED | Wetting angle (°) | Minimum contact time (min) | wetting angle (°) | Minimum contact time (min) |
| Composition 2 of the invention | ≅0 | 200 | ≅0 | 120 |

The results of this example show that the degreasing of each blade, by the prior art process, covered with mixture A or mixture B, is only partial for a total time of 255 minutes for this process, at a temperature of 50° C. and for very concentrated solutions of nitric acid and caustic soda.

Whilst the process and the composition according to the invention provide total degreasing of the blades, whatever the mixture A or B covering these blades, for a total treatment time of 200 and 30 minutes, for solutions up to ten times less concentrated than the solutions of prior art, and at ambient temperature.

In addition, supplementary trials have shown that a blade degreased with composition 1 or 2 is perfectly wettable by 5N nitric acid, which is not the case for a blade degreased by the solutions and process of prior art.

EXAMPLE 2

Kinetics of Degreasing of a Surface with a Composition According to the Invention In this example, a metallic blade covered with 0.75 g/cm$^2$ of a mixture C of solvent TPH+TBP+HDBP+$H_2$MBP comprising respectively 70; 27; 1.8 and 1.2% by weight of these solvents and a metallic blade covered by 1.2 mg/cm$^2$ of a mixture D of solvent TBP+HDBP+$H_2$MBP comprising respectively 90; 6 and 4% by weight of these solvents, were degreased by soaking without agitation in an aqueous solution of the composition according to the invention comprising 0.5 mol.l$^{-1}$ of caustic soda, 0.12% by weight of SIMULSOL 98 (Trademark) and 0.57% by weight of SYTHIONIC P8020 (Trademark). Degreasing was carried out at ambient temperature. The degreasing kinetics were followed by measuring over time, and at regular intervals, the surface tension $\gamma\cos\theta$ of each blade using the WILHELMY submerged blade method and thus determining the corresponding $\cos\theta$. Table 2 below groups the results of this example.

TABLE 2

| degreasing kinetics of a surface with a composition according to the invention | | | | | | | | | | |
|---|---|---|---|---|---|---|---|---|---|---|
| Time (minutes) | 0 | 5 | 10 | 20 | 30 | 45 | 60 | 90 | 120 | 180 |
| mixture C: $\cos\theta$ | 0.83 | 0.75 | 0.69 | 0.71 | 0.78 | 0.90 | 0.90 | 0.95 | 1 | — |
| mixture D: $\cos\theta$ | 0.6 | 0.67 | 0.66 | 0.65 | 0.75 | 0.78 | 0.83 | 0.89 | 0.96 | 1 |

According to the results in this example, it appears that about 120 minutes are required for complete degreasing ($\cos\theta=1$) of the blade covered with mixture C and 180 minutes for complete degreasing of the blade covered with mixture D under the same conditions as for the composition according to the invention.

Identical kinetic trials corresponding to those of this example were carried out with a concentration of caustic soda, in the composition according to the invention, of 1 $mol.l^{-1}$. The degreasing kinetics were much faster, since 30 minutes were sufficient for complete degreasing of the blade covered with mixture D. These trials showed that the solubility of mixture D is 305 times higher with caustic soda at 1 $mol.l^{-1}$ than with caustic soda at 0.5 $mol.l^{1-}$.

In comparison, treatment of the same blades by caustic soda at a concentration of 0.5 $mol.l^{-1}$, without surfactant with agitation of 500 rev/min, for 120 minutes, did not obtain complete degreasing of the blades. In fact, the $\cos\theta$ obtained by this treatment was only 0.81.

Complementary tests showed that a dilution of a composition according to the invention by a factor of 2 raised the degreasing time by the same factor.

EXAMPLE 3

Efficiency of Degreasing of a Surface with a Slightly Foaming Composition According to the Invention This example illustrates the efficiency of degreasing a surface by the slightly foaming solutions according to the invention.

In this example, the compositions used comprised a constant caustic soda concentration equal to 0.5 mol. $l^{-1}$, and a constant concentration of ether of oleic alcohol and polyoxyethylene glycol equal to 0.2% by weight. The fatty alcohol used was SIMULSOL 98 (Trademark) manufactured by the SEPPIC company. These compositions comprise a variable concentration of block copolymer of the Trademark SYNTHIONIC P8020 manufactured by the WITCO company, and also comprise a foam inhibitor again in a concentration which is also variable. This foam inhibitor agent is an alkyl phosphate of the Trademark MONTALINE ANP manufactured by the SEPPIC company. The surface to be degreased is a steel blade covered with 1 $mg/cm^2$ of TBP.

The degreasing was carried out at ambient temperature and without agitation of the degreasing solutions.

The degreasing efficiency of these solutions was evaluated by measuring the cloud point (in ° C.) of each of these solutions, by measurement of the time, in minutes, needed for each of these solutions to degrease the metallic blade completely to obtain a surface tension such that $\cos\theta\cong1$, and by measurement of the quantity (in g/l) of TBP which each solution can dissolve. The following table 3 groups the results of this example.

TABLE 3

Degreasing efficiency of slightly foaming compositions according to the invention

| Synthionic p8020 (%) | Montaline ANP (% by weight) | Cloud point (° C.) | Degreasing efficiency (min) for $\cos\theta \cong 1$ | TBP dissolvable (g/l) |
|---|---|---|---|---|
| 0.25 | 0.3 | 69 | 40 | 2.8 |
| 0.25 | 0.4 | 73 | 40 | 2.9 |
| 0.35 | 0.3 | 71 | 20 | 2.1 |
| 0.35 | 0.4 | 65 | 20 | 3 |

TABLE 3-continued

Degreasing efficiency of slightly foaming compositions according to the invention

| Synthionic p8020 (%) | Montaline ANP (% by weight) | Cloud point (° C.) | Degreasing efficiency (min) for $\cos\theta \cong 1$ | TBP dissolvable (g/l) |
|---|---|---|---|---|
| 0.45 | 0.3 | 55 | 20 | 1.5 |
| 0.45 | 0.4 | 59 | 20 | 1.2 |

These results show that for a concentration of caustic soda of 0.5 $mol.l^{-1}$ and for a concentration of SIMULSOL 98 of 0.2% by weight, the composition according to the invention comprising 0.35% by weight of SYNTHIONIC P8020 and 0.4% by weight of MONTALINE ANP seems to be the most efficient for dissolving TBP.

Trials for putting these compositions into circulation, by airlift, showed that the production of foam is sufficiently low not to choke the airlift separator trap.

EXAMPLE 4

Example of a Foam Comprising the Composition According to the Invention

The solutions used to form the foam of this example comprise. a concentration of SIMULSOL 98 (Trademark) greater than or equal to 0.4% by weight, a concentration of SYNTHIONIC (Trademark) greater than 0.26% by weight, and also comprise a foam destabilising agent. This destabilising agent is MONTALINE ANP (Trademark) described above as a foam inhibitor. In this example, all the compositions comprise a constant concentration of caustic soda equal to 0.75 $mol.l^{-1}$.

Foams were produced from these compositions by a static generator composed of a cylinder 120 mm long and 8 mm in diameter filled with 3.24 g of porous packing of the FORAFLON type (Trademark).

The generator was fed with each foaming solution by using a gear pump with flow rate of liquid of 23 to 28 l/hr and of air of 88 l/hr in normal conditions of temperature and pressure. The foams were obtained at a flow rate of 120 to 130 l/hr, with expansion ranging from 6 to 7 and a lifetime of 15±2 minutes.

In this example, measurements were taken of the quantity of TBP and its derivatives HDBP and $H_2MPB$ (in g/kg) which can be dissolved in different compositions according to the invention. Tests were carried out at ambient temperature.

Table 4 below groups the results obtained in this example.

TABLE 4

Dissolving of TBP for different foams comprising the composition according to the invention

| | | | | | |
|---|---|---|---|---|---|
| TBP + HDBP + H2MBP (g/kg) ($NaOH = 0.75\ mol.l^{-1}$) | 0 | 0.6 | 1.2 | 2 | 2.5 |
| SIMULSOL 98 (% by weight) | 0.4 | 0.6 | 0.9 | 1.2 | 1.45 |
| SNYTHIONIC P8020 (% by weight) | 0.26 | 0.4 | 0.6 | 0.8 | 0.95 |
| MONTALINE ANP (% by weight) | 0.3 | 0.3 | 0.3 | 0.3 | 0.3 |

These results show that when the levels of SIMULSOL 98 and SYNTHIONIC P8020 are raised, the dissolving of TBP is raised.

Supplementary tests with a composition comprising 0.75 mol.l$^{-1}$ NaOH, 0.8% by weight of SIMULSOL 98 (Trademark), 0.6% by weight of SYNTHIONIC P8020 (Trademark) and 0.4% of MONTALINE ANP (Trademark) made it possible to produce, with a flow rate of 1200 l/hr of air and 200 l/hr of liquid, a foam with a flow rate of 1400 l/hr, with a lifetime of 20 minutes.

These foam compositions showed a degreasing efficiency identical to that of the preceding examples 1 to 3, concerning the liquid composition according to the invention.

EXAMPLE 4

Example of a Gel Comprising the Composition According to the Invention

The gel produced in this example comprises 1 mol.l$^{-1}$ NaOH, 0.2% by weight of SIMULSOL 98 (Trademark), 0.45% by weight of SYNTHIONIC P8020 (Trademark) and also comprises a viscosity agent. This viscosity agent is xanthan gum KELZAN 140X (Trademark) and is added to the composition according to the invention at 1.2% by weight. The gel obtained has a viscosity of 0.8 Pa.s (800 cps) which varies little with temperature.

This gel makes it possible to degrease a metallic blade covered with TBP and its derivatives with the same efficiency as the compositions of examples 1 to 3 above.

EXAMPLE 5

Comparative Example of Radiochemical Decontamination of a Surface Between a Process According to the Invention and a Process of Prior Art This example is a comparative example of the efficiency of radiochemical decontamination of a surface by a process of the present invention compared with radiochemical contamination according to prior art.

In this example, the surfaces to be degreased and to be radioactively decontaminated are approximately cylindrical sections in stainless steel coming from organic phase probes from a nuclear fuel extraction plant. They are numbered from 1 to 9. These surfaces were put in contact with TBP, TPH, HDBP and $H_2$DBH, and their radioactivity is due to more than 98% of ruthenium 106 ($^{106}$Ru). Before taking samples, they underwent a rinsing with concentrated nitric acid and then measurement of their radioactivity in $^{106}$Ru. Hereinafter this radioactivity will be named $A_o$ and will correspond to the activity of each surface before radiochemical decontamination.

The radiochemical decontamination processes in this example comprise a degreasing of each surface, either according to a prior art process described in example 1, or according to the process of the invention, and radioactive decontamination by erosive treatment.

The process according to the invention used in this example comprises the following three stages, in this order:

soaking of the surface in a nitric acid solution at 5 mol.l$^{-1}$ for one hour at 50° C. with agitation, soaking of the surface in a solution according to the invention comprising 0.5 mol.l$^{-1}$ of NaOH, 0.12% by weight of SIMULSOL 98 (Trademark) and 0.57% by weight of SYNTHIONIC P8020 (Trademark) at 21° C. without agitation, and soaking in a solution at 0.5 mol.l$^{-1}$ for one hour at 50° C. with agitation.

Measurement of the residual radioactive activity $^{106}$Ru (AR1) was carried out for each surface after degreasing, and before radioactive decontamination, to measure the decontamination of the surface due to degreasing. Working from these measurements, a radioactive decontamination factor FD1=$A_o$/AR1 was calculated for each degreased surface.

Table 5 groups the results of these measurements and makes it possible to compare the degreasing effect of the invention on radioactive decontamination of a surface, compared with prior art.

TABLE 5

Degreasing effect of decontamination of a surface

| | Prior Art | | | | Invention | | | | |
|---|---|---|---|---|---|---|---|---|---|
| Surface | 1 | 2 | 3 | 4 | 5 | 6 | 7 | 8 | 9 |
| $A_o$ $^{106}$Ru × $10^6$Bq | 59.9 | 4.7 | — | — | 6.4 | 6.3 | 14.4 | 6.5 | 7.6 |
| AR1 $^{106}$Ru × $10^6$Bq | 6 | 1.37 | 2.1 | 3.05 | 0.29 | 0.46 | 0.34 | 0.29 | 0.23 |
| FD1 | 10 | 3.5 | — | — | 22 | 14 | 42 | 22.5 | 33 |

with $A_0$: $^{106}$Ru activity of the surface before degreasing

AR1 : $^{106}$Ru residual activity of the surface after degreasing

FD1 : decontamination factor of the surface after degreasing=$A_o$/AR1

These results show that the residual activity of the surfaces after degreasing treatment according to the invention is homogeneous and its average value is $0.32\times10^6$ Bq, that is an average decontamination factor FD1 of the order of 25. The surfaces degreased by the prior art process show much higher residual activities than those of the invention, such as $6\times10^6$ Bq and $1.37\times10^6$ Bq, that is to say a decontamination factor of 10 and 3.5 respectively.

The process according to the invention therefore seems significantly more efficient than the prior art process for degreasing a surface, and even for radioactive decontamination of this surface.

After these degreasing treatments, some of the surfaces underwent radioactive decontamination by an erosive treatment. This erosive treatment was either a cerium IV erosive treatment (T.E. Ce IV) for 2.5 hours, or an HF erosive treatment (T.E. HF) for 5.5 hours, or a ruthenium erosive treatment (T.E. Ru) for 2 hours, this latter treatment being followed by soaking in $HNO_3$ for 1 hour. These treatments have been described above.

After this radioactive decontamination treatment, the loss in weight Δm due to the erosive treatment and the residual activity $^{106}$Ru (AR2) of each surface degreased and decontaminated were measured. From this latter measurement, a total decontamination factor FDT=$A_0$/AR2 was determined for each surface. The FDT decontamination factor is that obtained for degreasing and decontamination of each surface.

Table 6 below groups the results of these measurements and calculations.

TABLE 6

Summary of example 5

| | Prior art | Invention | Prior art | Invention | | Prior art | Invention | |
|---|---|---|---|---|---|---|---|---|
| Surface | 2 | 5 | 3 | 6 | 7 | 4 | 8 | 9 |
| AR1 $10^6$Ru × $10^6$Bq | 1.37 | 0.29 | 2.1 | 0.46 | 0.34 | 3.05 | 0.29 | 0.23 |
| Erosive or specific treatment (TE) or (TS) | T.E. Ce IV 2.5 hr | | T.E. HF 5.5 hr | | | T.S. Ru = $KMnO_4$ | | |
| AR2$^{106}$Ru × $10^6$ Bq | 0.012 | 0.0012 | 0.1 | 0.016 | 0.005 | 0.12 | 0.011 | 0.014 |
| FDT | 388 | 3045 | 743 | 800 | 1266 | 480 | 590 | 462 |
| Δm(kg) × $10^{-6}$ | 65 | 57 | 65 | 77 | 78 | — | — | — |

These results demonstrate greater efficiency of radiochemical decontamination by the process according to the invention than by the prior art process. In fact, the residual activity AR2 $^{106}$Ru is about 10 to 20 times lower for a surface treated by the process according to the invention than by the prior art process, whatever the complementary treatment used: whether it be erosive, for example for Ce IV or HF, or specific for ruthenium. This improvement can be explained in particular by better preparation of the surfaces to be decontaminated by the degreasing process according to the invention compared with the prior art process.

These results also show that the degreasing process according to the invention is compatible with erosive treatments.

These results also show that the weight losses Δm measured are comparable for all surfaces, whatever the degreasing process and erosive treatment used. Thus there is no modification of erosion kinetics to be attributed to the degreasing treatment.

Complementary tests showed that a degreasing according to the invention applied for 3 hours, with the composition described above, without agitation, is just as efficient as with agitation. These tests were prolonged up to 3.5 hours, and showed that maximum efficiency, in these concentration conditions, and at a temperature of 25° C., was obtained in 3 hours, in particular concerning the residual activity of $^{106}$Ru.

EXAMPLE 6

Decontamination of an Active Cell by a Gel According to the Invention

In reprocessing plants, the cleaning of extraction units by solvent requires, before any decontamination, efficient degreasing so as to extract the TBP and its radiolysis products from the metallic surfaces.

The decontaminated cell had the function of partition U/Pu (2nd extraction cycle).

Contamination of the floor of this cell was caused by leaks of solvent containing U and Pu which were more or less spread by the interveners.

Part of this solvent was more or less radiolysed, which produced the black tarry deposits.

The average level of alpha surface contamination was estimated at a little below 2 Mbq/cm$^2$, that is, taking into account a floor surface of about 30 m$^2$, a total activity of alpha emitters of 0.57 Tbq.

The average isotopic composition, (% by weight) determined on the recuperated wastes was as follows:

$Pu^{238}$: 0.64

$Pu^{239}$: 81.3

$Pu^{240}$: 14.61

$Pu^{241}$: 2.48

$Pu^{242}$: 0.89

$Am^{241}$: 0.38

The dose rates measured in the cell fluctuated before each decontamination operation, between 0.3 and 10 mGy/hr according to the zones.

The formula according to the invention used had the following characteristics:

Simulsol 98: 2.0 g/l; 0.2% by weight

Synthionic P8020: 4.8 g/l; 0.48% by weight

Montaline ANP: 3.0 g/l; 0.3% by weight

NaOH: 1.0 mol/l water qsp: 1 l

The gel was applied on the floor (30 m$^2$) using a roller per portion of 5 to 6 m$^2$, insisting in particular on the zones identified as being the most irradiating.

After a contact time of 2 hours with the flooring, the contaminated gel was recuperated using a scraper and then submitted to natural drying in its original pot.

The most contaminated part of the cell (process side) was cleaned in 4 sequences without about 2 kg gel/m$^2$.

The rest of the cell was treated with 2 sequences (20 to 25 m$^2$ per 25 kg gel, that is about 1 kg gel per m$^2$).

An acid rinsing (10 l nitric acid) was necessary to eliminate the final traces of gel present on the flooring.

The cell flooring was perfectly wettable by nitric acid after the degreasing. The nitric acid used was recuperated with the aid of polypropylene cloths.

The results obtained are summarised in table 7 below:

| Reactive agents used (volumes) | Specifications of the gel (weights) |
|---|---|
| Degreasing gel: 37 l | NaOH: 1480 g |
| $HNO_3$ (1 mol.l$^{-1}$): 10 l | Surfactants: 285 g |
| | Viscosity agent: 444 g |

| | Indicator | Before degreasing | After degreasing | Decontamin. factor |
|---|---|---|---|---|
| (*) | weight of Pu (g) | 73 | * 0.069 | >1050 |
| (**) | Average alpha surface activity (Bq/cm$^2$) | 1.9.10$^6$ | 1.7.10$^3$ | ≅1100 |

It is to be noted that after degreasing, the absorbed dose rates measured in the cell had fallen in the interval [$2.10^{-2}$, $3.10^{-2}$]mGy/hr, that is a reduction factor of the dose rate of between 10 and 500.

Evaluation of the Wastes Produced

In order to be studied under good conditions, the solids were divided into batches weighing about one hundred grams each.

These batches were then measured individually by neutron counting (measurement of neutrons from spontaneous fission) and by gamma spectrometry.

The relative error of this type of measurement determined after a series of tests involving over a hundred different measurements is 25%.

The evaluation of the wastes generated is as follows for 53 kg of wastes and 73 g of plutonium:

for 13 kg of cloths (acid rinsing) and vinyl clothing: 7.2 g Pu.

for 40 kg of solid wastes composed of dried gels mixed with bentonite: 65.8 g of Pu.

The application of a surfactant formulation conditioned in gel form made it possible to degrease and decontaminate the floor of a cell which had been used for 6 years for U and Pu partitions (2nd extraction cycle).

The strong points of this surfactant formulation are as follows:

good degreasing of the surface practically without any mechanical effect even in the zones covered with tarry deposits (radiolysis of the solvent), putting into suspension the metal dibutyl phosphates which are the carriers of the main part of the radiochemical activity.

These results are encouraging for the applications of this surfactant formulation under liquid form.

What is claimed is:

1. A decreasing composition, comprising a base, a saturated or unsaturated polyethoxylated fatty alcohol, a copolymer of ethylene oxide and propylene oxide, and water, in which the base has a concentration in OH— ions in a range from 0.1 to 1.5 mol.$l^{-1}$, in which the saturated or unsaturated polyethoxylated fatty alcohol, is at a concentration in a range from about 0.01 to about 1.5% by weight, and in which the copolymer of ethylene oxide and propylene oxide has a concentration in a range from about 0.025 to about 1.5% by weight.

2. A composition according to claim 1, in which the fatty alcohol is selected from the group consisting of lauryl alcohol, myristyl alcohol, cetyl alcohol, stearyl alcohol, arachidyl alcohol, myristyl alcohol, oleic alcohol and linoleic alcohol.

3. A composition according to claim 1, in which the polyethoxylated fatty alcohol is a compound of the following formula (I):

$$R—(—O—CH_2—CH_2)_n—OH \quad (1)$$

in which R is a saturated or unsaturated alkyl group comprising from 10 to 24 atoms of carbon, and in which n represents the monomeric unit number of ethylene oxide, wherein n is fron 10 to 30.

4. A composition according to claim 1, in which the polyethoxylated fatty alcohol is a ether of oleic alcohol and an ethylene polyoxide with 20 monomeric units of ethylene oxide, according to the following formula (II):

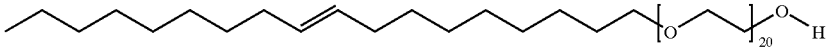

5. A composition according to claim 1, in which the copolymer of ethylene oxide and propylene oxide is a block copolymer.

6. A composition according to claim 1 in which the copolymer of ethylene oxide and propylene oxide is a block copolymer of the following formula (III):

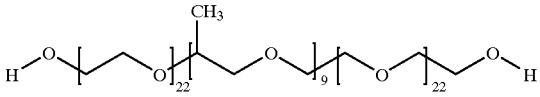

7. A composition according to claim 1 further comprising a foam inhibitor agent.

8. A degreasing liquid comprising a composition according to claim 1 comprising about 0.05 to about 0.4% by weight of polethoxylated fatty alcohol, about 0.025 to about 0.6% by weight of copolymer of ethylene oxide and propylene oxide, about 0.5 to about 1 mol.$l^{-1}$ in $OH^-$ ions, and further comprising a foam inhibitor agent.

9. A degreasing liquid according to claim 8, in which the foam inhibitor agent is a branched or unbranched alkyl phosphate, comprising 4 to 12 atoms of carbon.

10. A degreasing liquid according to claim 8 in which the inhibitor agent is a branched alkyl phosphate, comprising from 6 to 12 carbon atoms, at a concentration of 0.1 to 0.4% by weight.

11. A degreasing foam comprising a gaseous phase and a degreasing composition according to claim 1 which further comprises a foam destabilizing agent.

12. A degreasing foam comprising a gaseous phase, and a degreasing composition according to claim 1, in which said composition comprises a saturated or unsaturated polyethoxylated fatty alcohol, at a concentration in a range from about 0.4 to about 1.5% by weight, a copolymer of ethylene oxide and propylene oxide at a concentration in a range from about 0.4 to about 1.5% by weight, said composition which further comprises a foam destabilizing agent.

13. A degreasing foam according to claim 11, in which the foam destabilizing agent is a branched or unbranched alkyl phosphate, comprising from 4 to 12 atoms of carbon.

14. A degreasing foam according to claim 11 in which said foam destabilizing agent is a branched alkyl phosphate comprising 6 to 10 atoms of carbon, which is at a concentration of 0.2 to 1.1% by weight in the composition, wherein the weight ratio in the composition of the concentration of the saturated or unsaturated polyethoxylated fatty alcohol to the concentration of the copolymer of ethylene oxide and propylene oxide is about 1.5.

15. A degressing gel comprising a degreasing composition according to claim 1 and further comprising a viscosity agent.

16. A degreasing gel comprising a degreasing composition according to claim 1, in which the saturated or unsaturated polyethoxylated fatty alcohol has a concentration in a range from about 0.05 to about 1% by weight, the copolymer of ethylene oxide and propylene oxide has a concentration in a range from about 0.025% to about 0.4% by weight, and further comprising a viscosity agent.

17. A degreasing gel according to claim 15 in which the viscosity agent is selected from the group consisting of xanthan gum, an aluminum oxide and silica gel.

18. A process of degreasing a surface, said process comprising putting the surface to be degreased into contact with a composition according to claim 1.

19. A process of degreasing a surface, said process comprising putting into contact the surface to be degreased with a liquid according to claim 8.

20. A process of degreasing a surface, said process comprising putting into contact the surface to be degreased with a foam according to claim 11.

21. A process of degreasing a surface, said process comprising putting into contact the surface to be degreased with a gel according to claim 15.

22. A process of radiochemical decontamination of a surface comprising the steps of degreasing of the surface by a process according to claim 18 and subsequent radioactive decontamination of said degreased surface.

23. A process according to claim 22, in which the radioactive decontamination is decontamination by chemical erosion of sail surface.

24. A process according to claim 23, in which the chemical erosion of said surface is selected from the group consisting of cerium erosive treatment, an HF erosive treatment, or a ruthenium specific treatment.

* * * * *